United States Patent [19]

Ruschek et al.

[11] Patent Number: 4,541,379

[45] Date of Patent: Sep. 17, 1985

[54] VALVE ARRANGEMENT

[75] Inventors: Gerhard Ruschek, Hattersheim; Stephan Wietschorke, Usingen; Andreas Sausner, Frankfurt, all of Fed. Rep. of Germany

[73] Assignee: VDO Alolf Schindling AG, Frankfurt am Main, Fed. Rep. of Germany

[21] Appl. No.: 636,529

[22] Filed: Aug. 1, 1984

[30] Foreign Application Priority Data

Aug. 11, 1983 [DE] Fed. Rep. of Germany ..... 3328960

[51] Int. Cl.[4] ..... F02M 23/06

[52] U.S. Cl. ..... 123/339; 123/585

[58] Field of Search ..... 123/339, 585

[56] References Cited

U.S. PATENT DOCUMENTS 4,364,347 12/1982 Miyagi ..... 123/339

4,385,603 5/1983 Bonse et al. ..... 123/339

FOREIGN PATENT DOCUMENTS 69739 5/1980 Japan ..... 123/339

*Primary Examiner*—Tony M. Argenbright

*Attorney, Agent, or Firm*—Martin A. Farber

[57] ABSTRACT

A valve arrangement for regulating the idling speed of internal combustion engines by control of the quantity of air on the intake side of an intake manifold 1 leading to the combustion engine. It has an electromagnetic control member which has a solenoid 7 by which a closure member 4 is movable, via a control element, against the force of a return spring 8. A valve 11 which can be opened in the closed position of the closure member 4 is arranged within a connection 10 of given cross section from the inlet side to the outlet side of the closure member 4.

13 Claims, 1 Drawing Figure

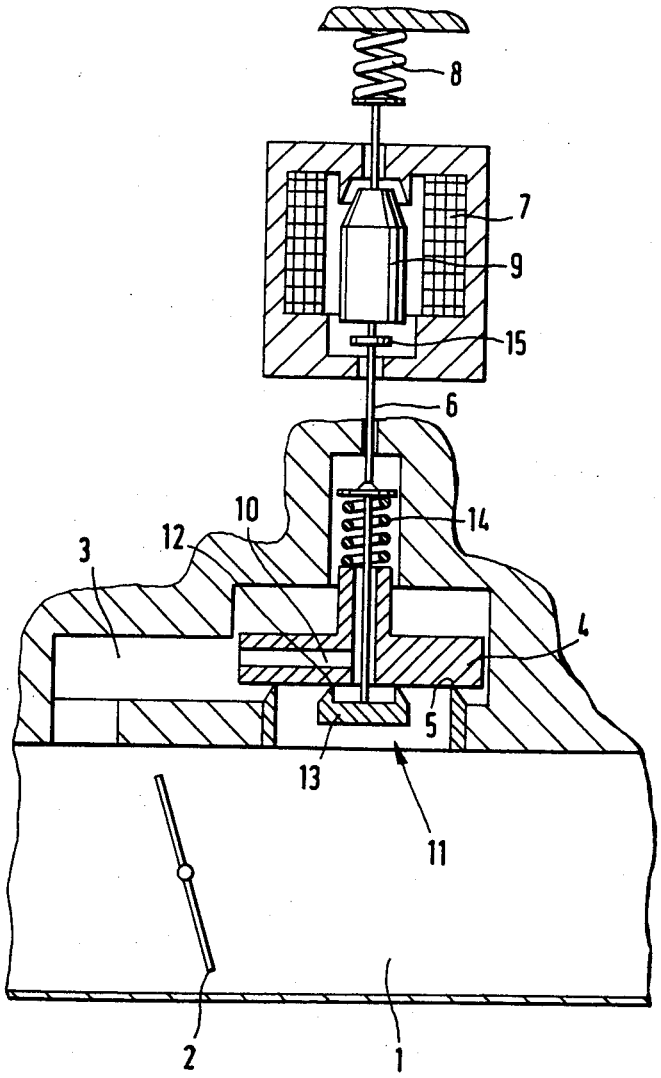
8
7
9
15
6
10
14
12
3
4
5
13
11
2
1

VALVE ARRANGEMENT

BACKGROUND OF THE INVENTION

The present invention relates to a valve arrangement for regulating the idling speed of internal combustion engines by controlling the quantity of air on the intake side of an intake manifold leading to the internal combustion engine, said arrangement having an electromechanical control member which has a solenoid by which a closure member can be moved via a control element against the force of a return spring.

Such valve arrangements serve to keep the idling speed of the engine as low as possible and at the same time also to regulate it in such a manner that, in the event of additional loads such as result, for instance, from auxiliary units, the idling speed does not drop down to an extent such the the engine stalls. For this purpose, the solenoid is acted on by a control current which is generated inter alia, as a function of the actual speed and which effects such a displacement of the closure member that the actual speed reaches a predetermined desired speed, substantially independently of disturbing variables.

When the solenoid is without current, the control member and, together with it, the closure member are moved by the return spring into either the fully open position or the fully closed position. This is the case if no current acts on the solenoid aside from the automotive operation.

However, this may also occur as a result of a defect by which the apply of current to the solenoid is interrupted.

In the traditional valve arrangements this has the result that the engine operates either with maximum idling speed or else with minimum idling speed, with the danger of the engine stalling.

One object of the invention is, therefore, to create a valve arrangement of the type described above which, by simple means, assures an idling speed which is as low as possible but at all times sufficiently high to prevent the stalling of the engine in the event of a failure of the solenoid.

SUMMARY OF THE INVENTION

According to the invention, a valve (11) which can be opened in the closed position of the closure member (4) is arranged in a connection (10) of given cross section leading from the inlet side to the outlet side of the closure member (4).

In this development, the cross section of the connection is so large that while stalling of the engine is prevented it is prevented, however, at the lowest possible speed. In normal operation, the flow of air takes place exclusively through the valve passage of the valve arrangement, without being influenced by the additional connection, since the latter is then closed. This connection opens only in the event that the solenoid is without current.

In order to save construction space, the connection (10) and the valve (11) can be arranged within the closure member (4).

The control element is preferably a push rod (6) which is connected to the movable armature (9) of the solenoid (7). Said rod can furthermore also be used for a second function in the manner that the valve (11) can be opened by the rod (6). A simple construction with only a few parts is thus obtained.

The closure member (4), which in closed position rests on the valve seat (5) of the valve arrangement and is acted on in the direction of closing by a spring (14), can be arranged in displaceable manner on the push rod (6). If the closure part (13) of the valve (11) is in this connection also fastened on the outlet-side free end of the push rod (6) and if the push rod (6) passes through the connection (10) which is developed axially in the closure member (4), at the outlet-side mouth of which the seat (12) of the valve (11) is formed, then a high degree of integration and double functions of the parts of the normal control and of the parts of the valve are obtained. For the normal regulating process, the closure part is held on its seat, from which it is automatically lifted when the passage of the normal regulation is closed.

The valve (11) is preferably a disk valve and can, in this way, at the same time form a stop for the push rod against which the closure member comes to rest in normal operation.

In order to make certain that the valve is opened when the solenoid is without current, the return spring (8) can urge the push rod (6) in closing direction and have a greater spring force than the spring (14) which acts on the closure member (4).

In order to limit the stroke of the closure member, this closure member (4) can be arranged for displacement between two stops on the push rod (6).

BRIEF DESCRIPTION OF THE DRAWING

With the above and other objects and advantages in view, the present invention will become more clearly understood in connection with the detailed description of a preferred embodiment, when considered with the accompanying drawing, the sole FIGURE of which is a cross section through the valve arrangement.

DETAILED DESCRIPTION OF THE PREFERRED EMBODIMENT

In an intake manifold 1 leading to an internal combustion engine (not shown) there is rotatably arranged a throttle valve 2. Via a bypass 3 the region in front of the throttle valve 2 can be placed in communication with the region behind the throttle valve 2. The passage of the bypass 3 can be blocked off to a greater or lesser extent by a valve arrangement, in the manner that its closure member 4 can be moved towards a valve seat 5. When the closure member 4 is seated, no air can flow through the bypass 3 from the atmosphere side to the intake side of the intake manifold 1.

The closure member 4 is axially displaceable on a push rod 6, which rod bears an armature 9 of a solenoid 7, and it is urged by a return spring 8 into closed position. When current flows through the solenoid 7, the push rod 6 is moved to a greater or lesser extent in the direction of opening against the force of the return spring 8.

The bore through which the push rod 6 passes, as well as a bore leading from said bore to the outlet side of the closure member 4, form a connection 10 which leads from the inlet side to the outlet side of the closure member 4. This connection 10 has a cross section which permits such a sufficient throughput of air that while stalling of the combustion engine in idling operations is reliably avoided, at the same time, however, the engine operates at the lowest speed possible for this.

The connection 10 can be closed by a valve 11 when operating with intact regulation. The seat 12 of the valve 11 which is developed as disk valve, is formed at the mouth of the connection 10 to the outlet side and can be closed by a closure part 13 which is fastened on the free end of the push rod 6 which passes through the connection 10. By means of a spring 14 which is of less force than the return spring 8 and rests against the push rod 6, the closure member 4 is brought against its valve seat 5.

When current flows through the solenoid 7, the closure part 13 comes against its seat 12 and, at the same time, forms a stop via which closure part 4 is lifted from its valve seat 5 by the push rod 6 which moves in the opening direction. The spring 14 in this connection holds the closure member 4 firmly applied against the closure part 13.

If the solenoid 7 should be without current, the return spring 8 moves the push rod 6, and thus also the closure member 4, in closing direction. After the closure member 4 comes against its valve seat 5, as shown in the FIGURE, the return spring 8 moves the push rod 6 further in closing direction to the extent that this is permitted by the stop 15. This movement is possible since the return spring 8, as a result of its greater force, can compress the spring 14.

By the further movement the closure part 13 of the valve 11 is simultaneously lifted from its seat 12 so that a flow of air necessary for the dependable idling operation of the internal combustion engine and determined by the cross section of the connection 10 its possible from the inlet side to the intake side.

We claim:

1. In a valve arrangement for regulating the idling speed of an internal combustion engine by controlling the quantity of air on an intake side of an intake manifold leading to the internal combustion engine, said valve arrangement including a return spring, a moveable closure member, and an electromechanical control member having a solenoid arranged for moving said closure member against the force of the return spring via a control element, the improvement comprising:

a connection of predetermined cross section connecting the intake side of the manifold to an inlet side of the closure member;

a valve operatively arranged with respect to said connection, said valve being openable in a closed position of said closure member; and said connection is arranged within said closure member and said valve is mounted on said closure member.

2. The arrangement according to claim 1, wherein:

said solenoid includes a movable armature and said control element comprises a push rod connected to said movable armature.

3. In a valve arrangement for regulating the idling speed of an internal combustion engine by controlling the quantity of air on an intake side of an intake manifold leading to the internal combustion engine, said valve arrangement including a return spring, a movable closure member, and an electromechanical control member having a solenoid arranged for moving said closure member against the force of the return spring via a control element, the improvement comprising:

a connection of predetermined cross section connecting the intake side of the manifold to an inlet side of the closure member;

a valve operatively arranged with respect to said connection, said valve being openable in a closed position of said closure member;

said solenoid includes a movable armature and said control element comprises a push rod connected to said movable structure;

said push rod is operatively connected so as to open said valve.

4. The arrangement of claim 3, wherein said closure member is displaceably arranged on said push rod and in said closed position said closure member rests on a valve seat of said valve arrangement;

said arrangement further comprising a spring means for urging said closure member in the direction of said closed position thereof.

5. The arrangement of claim 4, wherein said connection is formed axially in said closure member and opens into an outlet-side mouth of said connection in said closure member, the latter forming a seat for said valve adjacent said mouth; and said push rod passes through said connection, said push rod having an outlet-side free end;

said valve further including a closure part connected to the outlet-side free end of said push rod.

6. The arrangement of claim 5, wherein said valve is a disk valve.

7. The arrangement of claim 5, wherein:

said closure part, acting as a stop for said push rod, engages said valve seat of said closure member in normal operation in an open position of said closure member.

8. The arrangement of claim 4, wherein:

said return spring biases said push rod in a closing direction of said closure member and has a greater spring force than said spring means.

9. The arrangement of claim 4, wherein:

said push rod includes a first and a second stop; and wherein said closure member is operatively arranged for displacement between said first and said second stops.

10. The arrangement of claim 4, wherein said spring means is mounted on said push rod and further biases said valve in a closing direction, and said return spring further biases said push rod in an opening direction of said valve.

11. The arrangement according to claim 10, wherein said solenoid when actuated moves said push rod against the biasing of said return spring.

12. The arrangement of claim 11, wherein said connection is formed axially in said closure member and opens into an outlet-side mouth of said connection in said closure member, the latter forming a seat for said valve adjacent said mouth; and said push rod passes through said connection, said push rod having an outlet-side free end;

said valve further including a closure part connected to the outlet-side free end of said push rod.

13. In a valve arrangement for regulating the idling speed of an internal combustion engine by controlling the quantity of air on an intake side of an intake manifold leading to the internal combustion engine, said valve arrangement including a return spring, a moveable closure member, and an electromechanical control member having a solenoid arranged for moving said closure member against the force of the return spring via a control element, the improvement comprising:

a connection of predetermined cross section connecting the intake side of the manifold to an inlet side of the closure member;

a valve operatively arranged with respect to said connection, said valve being openable in a closed position of said closure member;

a throttle valve in said intake manifold dividing said intake side of said intake manifold from an inlet side of said intake manifold;

a bypass communicating said intake side of said intake manifold with the inlet side of said intake manifold via said connection of said closure member, respectively, the latter being movably mounted in said bypass for opening and closing said bypass via said solenoid and said control element; and wherein said connection is formed in said closure member communicating said inlet side of the closure member with an outlet side of said closure member;

said inlet side of the closure member communicates with said inlet side of said intake manifold and said outlet side of said closure member communicates with said intake side of said intake manifold; and said closed position of said closure member closes said bypass, while said valve opens said connection thereby communicating said intake said of said intake manifold with the inlet side of said intake manifold via said connection and thereby via said bypass.

* * * * *